US006331044B2

(12) United States Patent
Sleger et al.

(10) Patent No.: US 6,331,044 B2
(45) **Date of Patent: *Dec. 18, 2001**

(54) CORROSION RESISTANT THERMAL INK JET PRINT CARTRIDGE AND METHOD OF MANUFACTURING SAME

(75) Inventors: Roger R. Sleger; Russell R. Grobe, both of Eagle, ID (US)

(73) Assignee: Hewlett-Packard Company, Palo Alto, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/428,145

(22) Filed: Oct. 27, 1999

(51) Int. Cl.[7] ..... B41J 2/14
(52) U.S. Cl. ..... 347/50; 347/64
(58) Field of Search ..... 347/50, 64, 63

(56) References Cited

U.S. PATENT DOCUMENTS

| | | | | |
|---|---|---|---|---|
| 4,188,417 | * | 2/1980 | Lichtenberg | 427/229 |
| 4,539,228 | * | 9/1985 | Lazarus | 427/180 |
| 4,777,494 | * | 10/1988 | Shibata et al. | 347/64 |
| 4,862,197 | * | 8/1989 | Stoffel | 347/50 |
| 5,896,241 | * | 4/1999 | Hilton et al. | 360/135 |

* cited by examiner

*Primary Examiner*—Judy Nguyen

(57) ABSTRACT

A thin film structure is fabricated using photolithographic techniques and includes a plurality of substrates defining a resistor film, a conductor film and a passivation layer. The resistor film is etched to provide a plurality of individual heaters. The conductor film is etched to provide a plurality of conductive traces. At least one passivation layer covers the conductor film. A plurality of electrical contact pads are also formed that extend through etched holes in the passivation layer so that the electrical contact pads make electrical contact with the conductive traces. A nozzle plate is attached to the thin film structure. The nozzle plate has a plurality of individual nozzle orifices and also defines a plurality of corresponding ejection cavities for receiving ink from an ink reservoir via capillary action. The ejection cavities are each aligned with a corresponding one of the heaters for thermally ejecting ink through the orifices onto an adjacent print medium, The thin film structure and the attached nozzle plate are mounted to a housing that includes the ink reservoir. A mixture of a volatile liquid carrier and at least one corrosion inhibitor is sprayed onto the portion of the thin film structure having the plurality of electrical contact pads. The mixture has a very low surface tension so that the mixture will wick into any minute crevices around the perimeters of the electrical contact pads. The liquid carrier is evaporated by passing the assembled print cartridge through an oven so that the corrosion inhibitor will hermetically seal the crevices. Moisture is thereby prevented from entering the minute crevices and causing corrosion that would otherwise lead to operational failures of the print cartridge.

15 Claims, 4 Drawing Sheets

CORROSION RESISTANT THERMAL INK JET PRINT CARTRIDGE AND METHOD OF MANUFACTURING SAME

BACKGROUND OF THE INVENTION

The present invention relates to printers, and more particularly, to thermal ink jet print cartridges.

Thermal ink jet print cartridges are extensively used in printers attached to personal computers. Such print cartridges are also sometimes referred to as pens. They provide good quality print and fast dry time on a variety of media, including common papers. They enable non-contact printing of both color and black and white text, graphics, and images, eliminating printer failures due to friction wear and foreign body interference. Their self-contained design and direct printer interconnect allows fast, simple replacement, while avoiding the necessity for ribbons, pumps etc. Thermal ink jet print cartridges are small, and virtually silent in operation. They have relatively low power consumption and EMI emissions.

A conventional ink jet print cartridge has an injection molded plastic outer rectangular housing with suitable projections and notches for precision registration in a reciprocating carriage of a printer. The plastic housing includes an ink reservoir. A nozzle plate on the outside of the plastic housing has a plurality of nozzle orifices. Underneath each nozzle orifice is a firing chamber (ink ejection cavity) commonly fed with ink from a plenum connected to the reservoir. Ink is expelled through each nozzle utilizing a corresponding resistor element which rapidly heats a minute quantity of ink in response to an energizing signal controlled by a microprocessor in the printer. In effect the minute quantity of ink is boiled and spit out of an orifice to form a dot on the print media. The vapor bubble grows rapidly and gives momentum to the ink above the bubble which in turn is propelled through the orifice in the nozzle plate. Ink rapidly refills the firing chamber from the plenum via capillary action.

Techniques have been developed for inexpensively manufacturing the aforementioned thermal printhead structure using well known integrated circuit fabrication techniques. A thin film substrate provides the resistor-conductor structure for thermally exciting the ink to eject it through the nozzles in the nozzle plate. The printhead resistor-conductor structure is typically fabricated on a glass substrate using standard thin film deposition and etching techniques. A dielectric material such as sputtered silicon dioxide is first deposited first onto the glass substrate as a barrier film to prevent leaching of impurities from the glass into the resistor and conductor films. The resistor film is tantalum-aluminum and is sputter deposited using a magnetron. Aluminum doped with a small percentage of copper is next deposited by magnetron sputtering to form the conductor film. The resistor-conductor films are photolithographically patterned to form a column of resistors connected by a common conductor on one end and terminated by an array of individual aluminum electrical contact pads on their other ends. The resistors are covered with ink-resistant passivation films such as silicon carbide over silicon nitride. The electrical contact pads are typically formed of nickel and make contact through the passivation layers with the underlying aluminum-copper conductor film layer. When the print cartridge is installed in the printer, the electrical contact pads register with a corresponding array of contact pads in the printer carriage which are in turn connected to a circuit board in the printer through a flexible ribbon cable. To improve electrical contact pad reliability, the electrical contact pads are coated with gold film.

A nozzle plate made of electroformed nickel with a plurality of individual nozzle orifices is attached to the thin film structure such that each orifice is aligned with respect to the resistors. A capillary ejection cavity exits between each nozzle orifice and resistor. To print a dot, the selected resistor is energized by a suitable electrical pulse and rapidly heated to several hundred degrees C. in a few microseconds. The ink-vapor bubble formed adjacent to the resistor propels an ink droplet out of the nozzle orifice to form a dot on the adjacent paper or other print media. After the electrical pulse terminates, the vapor bubble collapses, subjecting the thin film substrate passivation to severe hydraulic forces. Thus, during operation of the printhead, the passivation experiences severe electrical, thermal, mechanical and chemical stresses.

The thin film structure of a conventional thermal ink jet printhead is inherently subject to defects during fabrication. Any type of defect that might allow ink to reach the thin film metalization is normally fatal to the proper operation of the printhead. Such defects include pinholes intrinsic to the passivation, particulate inclusions and minute crevices (micro-cracks) along conductor edges. Optimization of the deposition processes can adequately address pinholes and particulate inclusions. However, crevices adjacent the edges of the electrical contact pads have been particularly problematic. Any abrupt slope discontinuity in the passivation at this edge is likely to cause a failure. To avoid this, the edges of the through holes in the passivation layers into which the electrical contact pads extend are beveled to improve the subsequent step coverage. However this beveling is difficult to control and is very sensitive to surface quality, materials, and process variations.

The perimeters of the electrical contact pads are particularly susceptible to corrosion because the normal protective films (passivation) must be etched away at the location of the electrical contact pads in order to achieve electrical connection with the corresponding internal aluminum-copper traces. The etched areas are plated up with nickel to form durable contacts that are used to physically mate with corresponding contact pads in the printer carriage. Unfortunately, the etching process followed by the plating process does not ensure a hermetic seal. Even the tiniest sealing flaw allows moisture and oxygen to penetrate the corrosion susceptible films via minute crevices. Once oxydation or other corrosion initiates it can rapidly propagate (filiform corrosion) due to high humidity in either the test environment or the actual use environment. This corrosion can cause serious printhead operation failures. Efforts to provide a commercially viable solution that will prevent corrosion in the electrical contact pads of thermal ink jet print cartridges have heretofore not met with success despite the fact that this problem has existed since the commercial introduction of such cartridges approximately two decades ago.

SUMMARY OF THE INVENTION

It is therefore the primary object of the present invention to provide a low cost, reliable solution that will prevent operational failures in thermal ink jet print cartridges due to corrosion in their thin film electrical contact pads.

The present invention provides a corrosion resistant thermal ink jet print cartridge. The cartridge has a hollow housing including a reservoir for holding a quantity of ink. A thin film structure is mounted on an exterior of the housing and includes a plurality of substrates including a resistor film, a conductor film, and a passivation layer. The resistor film is etched to provide a plurality of individual heaters. The conductor film is etched to provide a plurality of conductive traces. The passivation layer covers the conductor film. A plurality of electrical contact pads extend through etched holes in the passivation layer so that the electrical contact pads make electrical contact with the conductive traces. A nozzle plate is attached to the thin film structure. The nozzle plate has a plurality of individual nozzle orifices and defines a plurality of corresponding ejection cavities for receiving ink from the reservoir via capillary action. The ejection cavities are each aligned with a corresponding one of the heaters for thermally ejecting ink through the orifices onto an adjacent print medium. At least one corrosion inhibitor is applied to a portion of the thin film structure having the plurality of electrical contact pads and hermetically seals any minute crevices that have developed around a perimeter of the electrical contact pads. Moisture is thereby prevented from entering the minute crevices and causing corrosion that would otherwise lead to operational failures of the print cartridge.

The present invention also provides a method of manufacturing a corrosion resistant thermal ink jet print cartridge. A housing is provided that includes a reservoir for holding a quantity of ink. A thin film structure is fabricated that includes a plurality of substrates defining a resistor film etched to provide a plurality of individual heaters, a conductor film etched to provide a plurality of conductive traces, a passivation layer over the conductor film, and a plurality of electrical contact pads that extend through etched holes in the passivation layer so that the electrical contact pads make electrical contact with the conductive traces. A nozzle plate is attached to the thin film structure. The nozzle plate has a plurality of individual nozzle orifices and defines a plurality of corresponding ejection cavities for receiving ink from the reservoir via capillary action. The ejection cavities are each aligned with a corresponding one of the heaters for thermally ejecting ink through the orifices onto an adjacent print medium. The thin film structure and the attached nozzle plate are mounted to the housing. At least one corrosion inhibitor is applied to a portion of the thin film structure having the plurality of electrical contact pads to hermetically seal any minute crevices around a perimeter of the electrical contact pads. Moisture is prevented from entering the minute crevices and causing corrosion that would otherwise lead to operational failures of the print cartridge.

DESCRIPTION OF THE PREFERRED EMBODIMENTS

Figure 1:
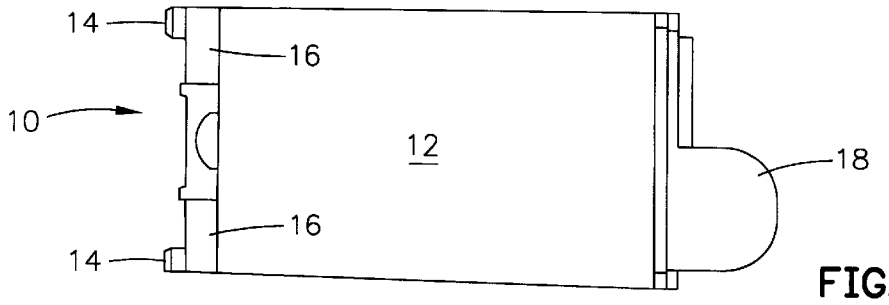
FIG. 1 is a side elevation view of a preferred embodiment of a thermal ink jet print cartridge constructed in accordance with the present invention.
Figure 2:
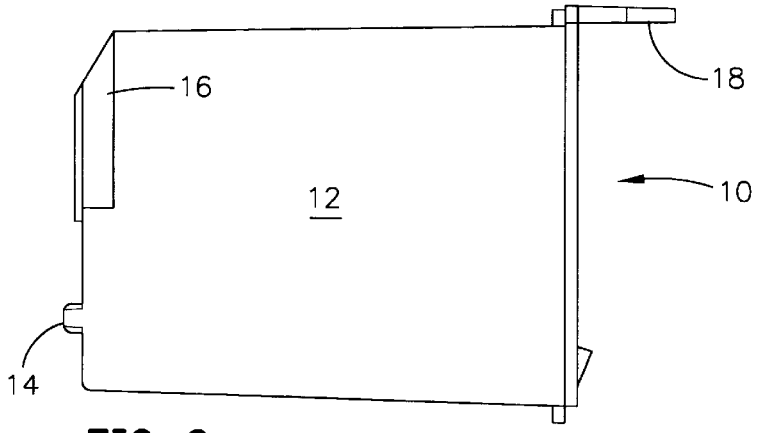
FIG. 2 is a side elevation view of the print cartridge of FIG. 1 taken from the bottom of FIG. 1.
Figure 3:
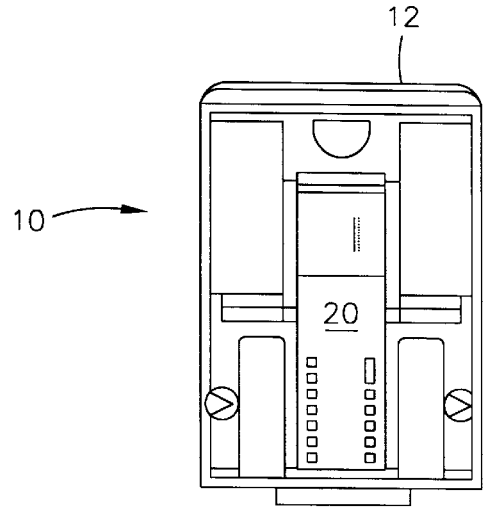
FIG. 3 is a side elevation view of the print cartridge of FIG. 1 taken from the left side of FIG. 2.
Figure 4:
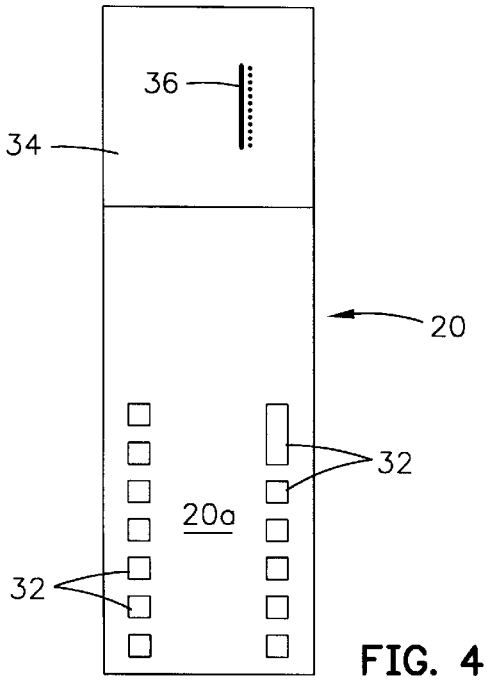
FIG. 4 is an enlarged elevation view of the nozzle plate and thin film structure of the print cartridge which is also visible in FIG. 3.

FIGS. 1–4 illustrate an exemplary form of a corrosion resistant thermal ink jet print cartridge 10. The print cartridge 10 has a generally rectangular hollow housing 12 that includes an internal reservoir for holding a quantity of ink. The housing 12 is preferably injection molded out of a suitable plastic and has projections 14 and notches 16 for precision registration in a reciprocating carriage (not illustrated) of a printer. A tab 18 extends from the housing 12 for manually engaging and releasing the cartridge 10 from the carriage.

Figure 5:
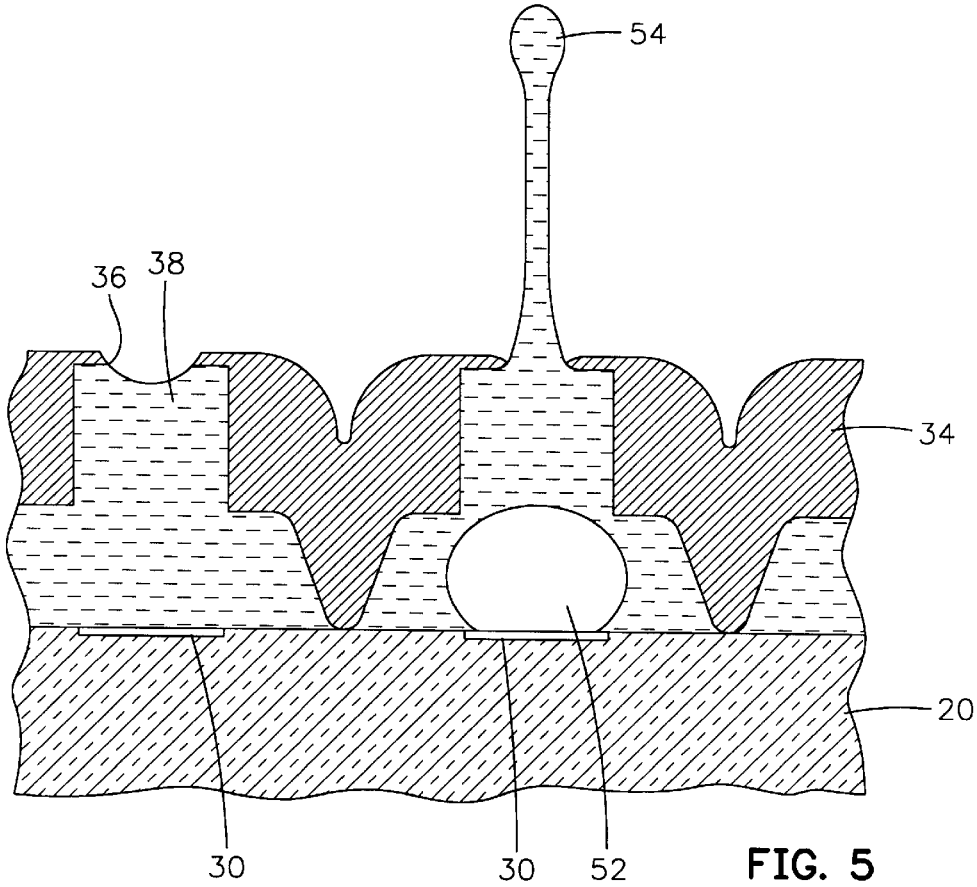
FIG. 5 is a greatly enlarged diagrammatic cross-sectional view of a portion of the thin film structure of the print cartridge of FIGS. 1–4 illustrating its nozzle plate and ink ejection cavities.
Figure 6:
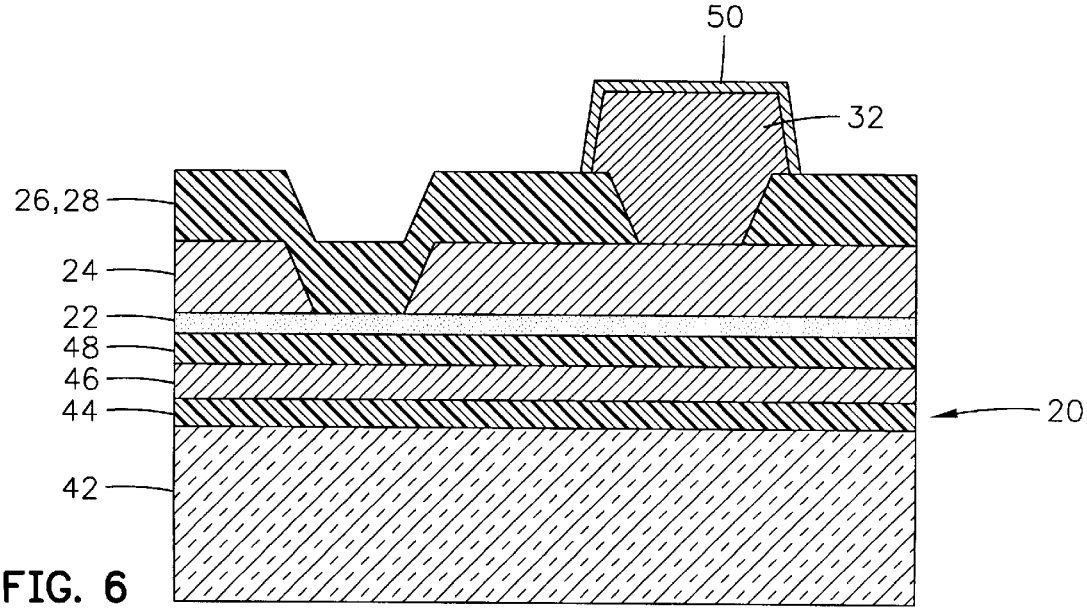
FIG. 6 is a still further enlarged diagrammatic cross-sectional view of another portion of the thin film structure of the print cartridge of FIGS. 1–4 illustrating its multi-layer architecture around the electrical contact pads.
Figure 7:
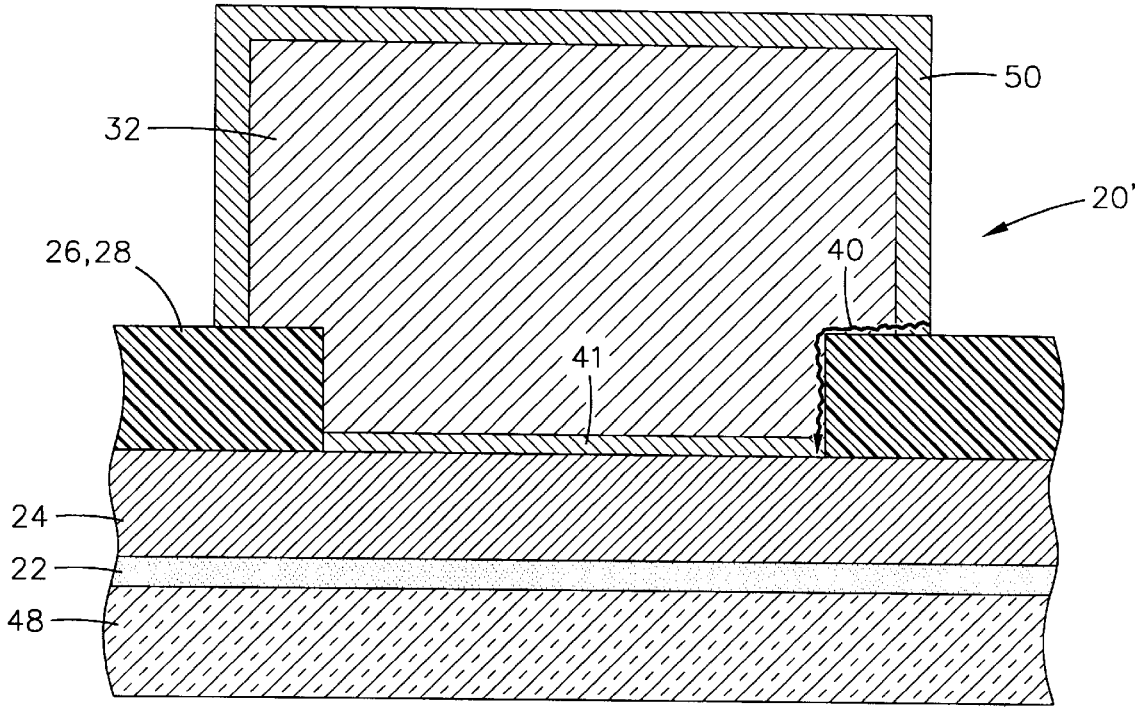
FIG. 7 is a still further enlarged, fragmentary diagrammatic view illustrating the crevices that form around the perimeters of the electrical contact pads of a slightly modified version of the thin film structure of the print cartridge of FIGS. 1–4.

A thin film structure generally designated 20 (FIGS. 3–6) is mounted on an exterior of the housing 12. As best seen in FIG. 6, the thin film structure 20 has a multi-layer construction and includes a plurality of substrates including a resistor film 22, a conductor film 24, and overlying passivation layers 26 and 28. The resistor film 22 is etched to provide a plurality of individual heaters 30 (FIG. 5). The conductor film 24 is etched to provide a plurality of conductive traces. The passivation layers 26 and 28 cover the conductor film 24. A plurality of electrical contact pads 32 (FIGS. 4 and 7) extend through etched holes in the passivation layers 26 and 28 so that the electrical contact pads 32 make electrical contact with the conductive traces. A nozzle plate 34 (FIG. 5) is attached to the thin film structure 20. The nozzle plate 34 has a plurality of individual nozzle orifices 36 and defines a plurality of corresponding ejection cavities 38 for receiving ink from the reservoir inside the housing 12 via capillary action. The cavities 38 are shown in FIG. 5 filled with ink. The ejection cavities 38 are each aligned with a corresponding one of the heaters 30 for thermally ejecting ink through the orifices 36 onto an adjacent print medium (not shown). A blend of corrosion inhibitors described in detail hereafter, is applied to the portion 20*a* (FIG. 4) of the thin film structure 20 having the plurality of electrical contact pads 32. The corrosion inhibitors hermetically seal any minute crevices 40 (FIG. 7) that typically developed around the perimeters of the electrical contact pads 32 during the fabrication of the thin film structure 20. Moisture is thereby prevented from entering the minute crevices 40 and causing corrosion where the contact pads 20 join the conductive traces etched in the conductor film 24. This corrosion leads to operational failures of the print cartridge 10. The architecture of the thin film structure 20' illustrated in FIG. 7 is slightly different from that of the thin film structure 20 illustrated in FIG. 6. In FIG. 7, the thin film structure 20' has a thin layer of zinc 41 deposited between the conductor film 24 and the electrical contact pads 32. The three additional layers beneath the silicon dioxide layer 48 are not shown in FIG. 7.

The primary mechanical support for the thin film structure 20 is provided by a glass substrate 42 (FIG. 6). The resistor-conductor architecture of the thin film structure 20 is fabricated on the glass substrate 42 using standard thin film deposition and etching techniques. A dielectric material such as a sputtered silicon dioxide underlayer 44 is first deposited first onto the glass substrate 42 as a barrier film to prevent leaching of impurities from the glass substrate 42 into the resistor film 22 and conductor film 24. A chrome heat sink layer 46 is deposited over the silicon dioxide layer 44. Another silicon-dioxide insulator layer 48 is deposited onto the heat sink layer 46.

The resistor film 22 is tantalum-aluminum and is sputter deposited onto the insulator layer 48 using a magnetron. Aluminum doped with a small percentage of copper is next deposited by magnetron sputtering to form the conductor film 24. The resistor-conductor films 22 and 24 are photolithographically patterned to form a column of resistors (heaters 30) that are connected by a common conductor on one end and terminated by the array of individual aluminum electrical contact pads 32 on their other ends. The resistors are covered with the ink-resistant passivation layers 26 and 28 that are formed of silicon nitride and silicon carbide, respectively. The electrical contact pads 32 are typically formed of nickel and make contact, through beveled holes formed in the passivation layers 26 and 28, with the underlying aluminum-copper conductor film layer 24.

When the print cartridge 10 is installed in a printer, the electrical contact pads 32 register with a corresponding array of contact pads in the printer carriage which are in turn connected to a circuit board in the printer through a flexible ribbon cable. To improve electrical contact pad reliability, the electrical contact pads 32 are coated with gold film 50 (FIG. 6).

The nozzle plate 34 (FIG. 5) is made of electroformed nickel and is formed with the plurality of individual nozzle orifices 36. The nozzle plate 34 is attached to the thin film structure 20 such that each orifice 36 is aligned with respect to a corresponding heater 30. The capillary ejection cavities 38 are defined between each nozzle orifice 36 and heater 30. To print a dot, the selected heater 30 (resistor) is energized by a suitable electrical pulse and rapidly heated to several hundred degrees C. in a few microseconds. An ink-vapor bubble 52 (FIG. 5) is formed adjacent to the heater 30 and propels an ink droplet 54 out of the nozzle orifice 36 to form a dot on the adjacent paper or other print media. After the electrical pulse terminates, the vapor bubble 52 collapses, subjecting the thin film substrate passivation layers 26 and 28 to severe hydraulic forces. Thus, during operation of the print cartridge 10, the passivation layers 26 and 28 experience severe electrical, thermal, mechanical and chemical stresses.

Further details of the construction of the thermal ink jet print cartridge 10 and the specialized inks used therein are well known to those skilled in the art of thermal ink jet printers. See for example, U.S. Pat. Nos. 4,500,895; 4,794,410; 5,278,584; and 5,305,015, the entire disclosures of which are incorporated herein by reference. However, prior to this invention, the use of corrosion inhibitors to seal crevices 40 was unknown.

The corrosion inhibitors are preferably applied using a volatile carrier liquid that will allow the corrosion inhibitor to be sprayed around the electrical contact pads 32 of the thin film structure 20. In addition, the carrier is preferably of the type that has a very low surface tension so that the carrier/inhibitor mixture will wick into the crevices 40 around the electrical contact pads 32. Once the carrier/inhibitor mixture has been applied and allowed to fully wick into the crevices 40, it is preferably evaporated by passing the assembled ink jet print cartridge 10 through at least one drying oven. This removes any carrier liquid that would otherwise remain on the electrical contact pads 32 and prevent proper electrical connection to these pads during assembly line testing of the print cartridge 10.

A wide variety of carrier liquid/corrosion inhibitor mixtures were tested on the electrical contact pads 32 of the inkjet print cartridge 10 described above. The best results were achieved using a petroleum based carrier liquid/corrosion inhibitor mixture commercially available in the United States from CORTEC CORPORATION of St. Paul, Minn., USA, under the designation ElectriCor VCI-238. It produced an order of magnitude reduction in failures of ink jet print cartridges attributable to corrosion around the electrical contact pads 32. Substantial corrosion protection was achieved with minimal risks. Chemical cracking of plastic posts which occurred in cartridge compatibility stress tests and a relatively low flash point of the carrier liquid were the only drawbacks. However, chemical cracking only occurred with high concentration (one thousand times) and high temperatures (fifty-five degrees C.), which the ink jet print cartridge 10 will not normally be exposed to. The chemical cracking will not occur if the volatile components of the carrier liquid/corrosion inhibitor are first evaporated away before the stress test. No cracking was found with coated pens in accelerated storage life testing (eighty degrees C. for four weeks). The flash hazard during the fabrication process can be alleviated with venting and by applying only small amounts of the ElectriCor VCI-238 mixture.

ElectriCor VCI-238 is a vapor corrosion inhibitor and cleaner that is sold as a clear yellow liquid mixture. The mixture is a blend of corrosion inhibitors in a solvent carrier. The Material Safety Data Sheet for the ElectriCor VCI-238 mixture indicates that approximately seventy to eighty weight percent of the liquid mixture comprises mineral spirits, e.g. hydrocarbn solvents, primarily petroleum distillates, which have flash points above thirty-eight degrees C. and distillation ranges between one hundred forty-nine degrees C. and two hundred thirteen degrees C. See ASTM Standard Specifications D 235–83, 71–73 (1983). A representative of the company indicated that ElectriCor VCI-238 comprises approximately seventy-five weight percent mineral spirits, with the balance made up of a blend of two corrosive inhibitor compounds, namely, an amine salt of fatty acids and triazole. U.S. Pat. Nos. 4,973,448; 5,139,700 and 5,854,145 assigned to CORTEC CORPORATION, disclose other corrosion inhibitor compounds that may also be useful in preventing corrosion around the electrical contact pads of thermal ink jet print cartridges, and the entire disclosures of these patents are incorporated herein by reference.

The ElectriCor VCI-238 is an effective inhibitor of galvanic action or dissimilar metal corrosion for the types of metals and metal alloys found in the thin film structure 20. It is nonconductive, has essentially neutral pH value and has the desired moisture displacing and penetrating film characteristics needed to seal the crevices 40.

A water-based liquid carrier/corrosion inhibitor mixture commercially available in the United States from CORTEC CORPORATION under the designation VCI-377 was tried unsuccessfully. The resistance in the electrical contact pads 32 increased after ASL testing, causing mis-firing nozzle orifices. The application of this mixture also resulted in chemical erosion of aluminum lands under the orifice plate with quick dry ink during compatibility testing. This erosion is believed to have been the result of the test methodology which did not allow the volatile component to evaporate and the ions to attach to the surface of the substrate.

Another liquid carrier/corrosion inhibitor mixture commercially available in the United States under the designation CRAIG GOLD was also tested by spraying it around the contact pads of the thin film substrate. The performance of this mixture fell short of the CORTEC VCI 238 mixture.

Figure 8:
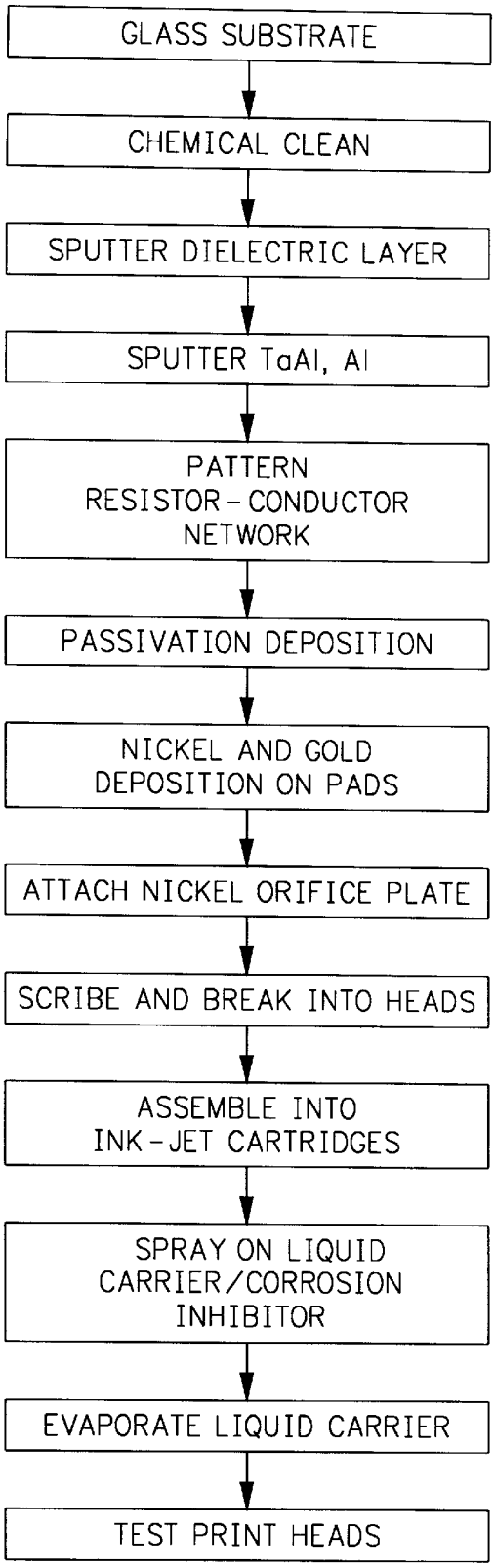
FIG. 8 is a flow chart of a manufacturing process for manufacturing the print cartridge of FIGS. 1–4.

From the description above, it will be appreciated that the present invention also provides a method of manufacturing a corrosion resistant thermal ink jet print cartridge 10. A hollow housing 12 is provided that includes a reservoir for holding a quantity of ink. A thin film structure 20 is fabricated that includes a plurality of substrates defining a resistor film 22 etched to provide a plurality of individual heaters 30, a conductor film 24 etched to provide a plurality of conductive traces, passivation layers 26 and 28 that are deposited over the conductor film 24, and a plurality of electrical contact pads 32 that extend through etched holes in the passivation layers 26 and 28 so that the electrical contact pads 32 make electrical contact with the conductive traces. A nozzle plate 34 is attached to the thin film structure 20. The nozzle plate 34 has a plurality of individual nozzle orifices 36 and defines a plurality of corresponding ink ejection cavities 38 for receiving ink from the reservoir inside the housing 12 via capillary action. The ejection cavities 38 are each aligned with a corresponding one of the heaters 30 for thermally ejecting ink 54 through the orifices 36 onto an adjacent print medium. The thin film structure 20 and the attached nozzle plate 34 are mounted to an exterior of the housing 12. A corrosion inhibitor blend is applied to a portion of the thin film structure having the plurality of electrical contact pads 32 to hermetically seal any minute crevices 40 around a perimeter of the electrical contact pads 32. Moisture is prevented from entering the minute crevices 40 and causing corrosion that would otherwise lead to operational failures of the print cartridge. FIG. 8 is a flow chart illustrating the overall process for manufacturing the print cartridge of FIGS. 1–4.

Figure 9:
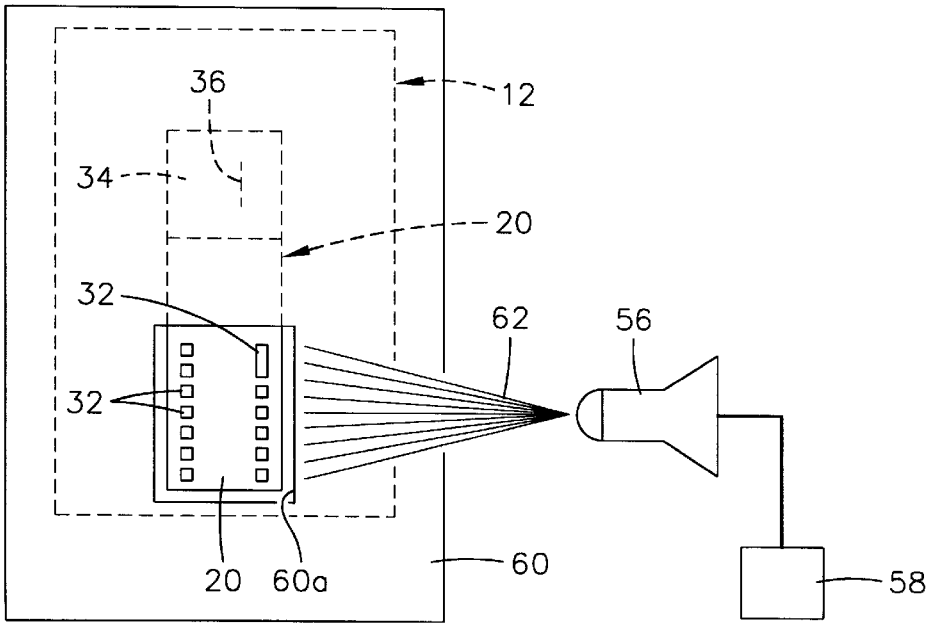
FIG. 9 is a diagrammatic illustration of the spray application of a liquid corrosion inhibitor through a template to the portion of the print cartridge of FIGS. 1–4 having the electrical contact pads.

The mixture of corrosion inhibitors and the liquid carrier is preferably applied to the thin film structure 20 by spraying. This may be accomplished on an assembly line basis using a spray nozzle 56 (FIG. 9) connected to a pressurized source 58 of the mixture. A template 60 with an opening 60*a* is placed over the assembled cartridge 10 so that only the portion 20*a* of the thin film structure 20 having the electrical contact pads 32 is exposed to the atomized mixture spray 62 and coated with a very thin layer of the mixture. Alternatively, a flexible boot (not shown) may be associated with the spray nozzle 56 for accomplishing the same confined application of the liquid carrier/corrosion inhibitor mixture. The mixture can also be applied manually to the contact pad portion 20*a* of the thin film structure 20 using an aerosol spray can.

The mixture that has been applied to the thin film structure 20 is allowed to fully wick into the crevices 40 (FIG. 7). Thereafter, the liquid carrier portion is evaporated to leave substantially only the corrosion inhibitor. The liquid carrier is preferably evaporated by passing the assembled print cartridge 10 through two successive drying ovens (not shown). This allows the electrical contact pads 32 of the print cartridge 10 to immediately be connected to corresponding electrical connections in a fixture in the assembly line (not shown) for functionality testing.

While the corrosion barrier achieved by applying the carrier/inhibitor mixture as indicated above will not be permanent, it need only last during the usefull life of the print cartridge 10 which is normally disposed of as soon as its ink reservoir is empty. Refilling of such print cartridges is not recommended since the thin film structure 20 and other components are not designed for long life. Furthermore, proper operation of the ink jet print cartridge 10 is highly dependent upon the use of highly specialized inks which are not commercially available.

Whereas a preferred embodiment of a corrosion resistant thermal ink jet print cartridge, and a preferred embodiment of a method of manufacturing that print cartridge have both been described, modifications and adaptations of the present invention will occur to those skilled in the art. For example, the present invention is applicable to other thermal ink jet print cartridges besides the specific example described. In addition, other liquid carrier/inhibitor mixtures besides the ElectriCor VCI-238 vapor corrosion inhibitor described above may also provide beneficial results. The liquid carrier can be allowed to evaporate over time under ambient conditions. The liquid carrier/corrosion inhibitor mixture can be applied to the thin film structure before it is assembled with the hollow cartridge housing. Therefore, the protection afforded the present invention should only be limited in accordance with the scope of the following claims.

We claim:

1. A corrosion resistant thermal ink jet print cartridge, comprising:

a housing;

a thin film structure mounted to the housing and including a plurality of electrical contact pads;

a nozzle plate attached to the thin film structure, the nozzle plate having a plurality of individual nozzle orifices; and at least one corrosion inhibitor applied to a portion of the thin film structure having the plurality of electrical contact pads and hermetically sealing any minute crevices that have developed around a perimeter of the electrical contact pads;

whereby moisture is prevented from entering the minute crevices and causing corrosion that would otherwise lead to operational failures of the print cartridge.

2. The print cartridge of claim 1 wherein the corrosion inhibitor is a blend of different corrosion inhibitors.

3. The print cartridge of claim 1 wherein the corrosion inhibitor is mixed with a liquid carrier before being applied to the portion of the thin film structure having the plurality of electrical contact pads.

4. The print cartridge of claim 3 wherein the mixture of the corrosion inhibitor and the liquid carrier has a very low surface tension so that it will wick into the crevices to enable the inhibitor to hermetically seal the crevices after the carrier has evaporated.

5. The print cartridge of claim 3 wherein the mixture of the corrosion inhibitor and the liquid carrier comprises approximately seventy to eighty weight percent mineral spirits with the balance made of the corrosion inhibitor.

6. The print cartridge of claim 5 wherein the corrosion inhibitor compounds include an amine salt of fatty acids and triazole.

7. The print cartridge of claim 1 wherein the corrosion inhibitor is selected from the group consisting of an amine salt of fatty acids and triazole.

8. The print cartridge of claim 1 wherein the thin film structure includes a plurality of substrates defining a resistor film, a conductor film and at least one passivation layer, the conductor film being made of aluminum doped with a small percentage of copper.

9. The print cartridge of claim 1 wherein the thin film structure includes a first passivation layer of silicon nitride covered with a second passivation layer of silicon carbide.

10. The print cartridge of claim 8 wherein the contact pads extend through beveled holes etched in the passivation layer.

11. A method of manufacturing a corrosion resistant thermal inkjet print cartridge, comprising the steps of:

providing a housing;

fabricating a thin film structure including a plurality of substrates defining a resistor film etched to provide a plurality of individual heaters, a conductor film etched to provide a plurality of conductive traces, at least one passivation layer over the conductor film, and a plurality of electrical contact pads that extend through etched holes in the passivation layer so that the electrical contact pads make electrical contact with the traces;

attaching a nozzle plate to the thin film structure, the nozzle plate having a plurality of individual nozzle orifices and defining a plurality of corresponding ejection cavities for receiving ink, the ejection cavities each being aligned with a corresponding one of the heaters for thermally ejecting ink through the orifices onto an adjacent print medium;

mounting the thin film structure and the attached nozzle plate to the housing;

applying a mixture of a volatile liquid carrier and a blend of corrosion inhibitors on a portion of the thin film structure having the plurality of electrical contact pads, the mixture being made of approximately 70–80 weight percent mineral sprits with the balance made of an amine salt of fatty acids and triazole for penetrating any minute crevices around the perimeters of the electrical contact pads; and evaporating the liquid carrier so that the corrosion inhibitors will hermetically seal the crevices;

whereby moisture is prevented from entering the minute crevices and causing corrosion that would otherwise lead to operational failures of the print cartridge.

12. A corrosion resistant thermal ink jet print cartridge, comprising:

a housing;

a thin film structure mounted to the housing and including a plurality of electrical contact pads;

a nozzle plate attached to the thin film structure, the nozzle plate having a plurality of individual nozzle orifices; and a blend of corrosion inhibitors hermetically sealing any minute crevices that have developed around a perimeter of the electrical contact pads, the blend of corrosion inhibitors including an amine salt of fatty acids and triazole;

whereby moisture is prevented from entering the minute crevices and causing corrosion that would otherwise lead to operational failures of the print cartridge.

13. The print cartridge of claim 12 wherein the corrosion inhibitors are mixed with a liquid carrier before being applied to the portion of the thin film structure having the plurality of electrical contact pads.

14. The print cartridge of claim 13 wherein the mixture of the corrosion inhibitors and the liquid carrier has a very low surface tension so that it will wick into the crevices to enable the inhibitors to hermetically seal the crevices after the carrier has evaporated.

15. The print cartridge of claim 13 wherein the mixture of the corrosion inhibitors and the liquid carrier comprises approximately seventy to eighty weight percent mineral spirits with the balance made of the corrosion inhibitors.

* * * * *